United States Patent [19]

Raasch

[11] 4,136,511

[45] Jan. 30, 1979

[54] METHOD AND DEVICE TO DETERMINE DEFECTIVELY OPERATING SPINNING STATIONS

[75] Inventor: Hans Raasch, Mönchen-Gladbach, Germany

[73] Assignee: W. Schlafhorst & Co., Mönchen-Gladbach, Germany

[21] Appl. No.: 822,794

[22] Filed: Aug. 8, 1977

[30] Foreign Application Priority Data

Aug. 7, 1976 [DE] Fed. Rep. of Germany ..... 2635714

[51] Int. Cl.[2] ..... D01H 13/22

[52] U.S. Cl. ..... 57/265; 57/81; 57/261

[58] Field of Search ..... 57/34 R, 81, 93, 156, 57/53, 78, 80, 83

[56] References Cited

U.S. PATENT DOCUMENTS

| | | | |
|---|---|---|---|
| 3,099,829 | 7/1963 | Namenyi-Katz | 57/81 X |
| 3,523,413 | 8/1970 | Ford et al. | 57/81 X |
| 3,660,972 | 5/1972 | Neill et al. | 57/34 R |
| 3,680,298 | 8/1972 | Saunders | 57/34 R |
| 3,877,210 | 4/1975 | Seidl | 57/34 R |
| 3,908,347 | 9/1975 | Vignon | 57/34 R |
| 4,043,107 | 8/1977 | Günther | 57/34 R |
| 4,056,926 | 11/1977 | Stüber | 57/81 |
| 4,084,398 | 4/1978 | Stahlecker et al. | 57/81 X |

*Primary Examiner*—Donald Watkins
*Attorney, Agent, or Firm*—Herbert L. Lerner

[57] ABSTRACT

Method of determining incorrectly operating spinning stations of a spinning machine which includes counting with counting means for each spinning station the number of anomalous interruptions of the operation thereof, interrogating at the time intervals the count at the respective counting means with an operating device capable of traveling relatively to the spinning stations, and issuing a fault signal automatically if a predetermined count of the respective counting means for the spinning stations is reached or exceeded, and device for performing the foregoing method.

14 Claims, 3 Drawing Figures

METHOD AND DEVICE TO DETERMINE DEFECTIVELY OPERATING SPINNING STATIONS

The invention relates to a method and device for determining incorrectly or defectively operating spinning stations of a spinning frame by counting the anomalous interruptions of the operation of the spinning stations, for which purpose a counter, for example, in the form of an interrogatable memory, is associated with each spinning station. It is not always necessary to dispose the counters at the spinning stations per se. The counter may also be centrally disposed and, for example, a delineated counter location in this central counter may be assigned to each spinning station, respectively.

Incorrect operation of individual spinning stations in rotor spinning machines results, especially, from soiling of the rotor, but also from the wearing of machine parts. Incorrect operation of a spinning station results in most cases, in a thread break. An increase in the number of thread breaks beyond the average is, as a rule, an indication that, generally, a thread of inferior quality is being spun at the respective spinning station. It is therefore very important to detect an incorrectly operating spinning station early and, if possible, so early that the quality of the thread produced at this spinning station has not yet become too-greatly degraded. A determination that a spinning station is operating incorrectly can hardly be determined by the operating personnel, since the personnel are primarily busy correcting thread breaks. Only if the number of thread breaks at a given spinning station increases perceptibly is the incorrect operation of this spinning station determined.

It has become known heretofore to use process computers for monitoring rotor spinning machines. The expense of using a process computer is very great, however, and it is possible then only through additional expenditure to indicate directly at the spinning stations that an above-average number of thread breaks has occurred. For this purpose, remote indicating lines would have to be extended from the process computer back to every spinning station, and suitable signal amplifiers would also have to be associated therewith. As a general rule, the monitoring of rotor spinning machines by a process computer is economical only if other data are also to be collected and processed by the process computer.

It is an object of the invention to determine incorrectly operating spinning stations early at relatively low cost. The invention assumes the premise that, in modern spinning machines, operating devices which can be moved or which travel relative to the spinning stations are availabe. These mobile operating devices are, for example, thread-joining devices, tying devices, cleaning devices or coil changing devices. Usually, such operating devices are conducted or driven past the spinning stations. However, the reverse case is also conceivable, wherein the operating device is stationary, and the spinning stations travel past the operating device.

With the foregoing and other objects in view, there is provided, in accordance with the invention, a method of determining incorrectly operating spinning stations of a spinning machine which comprises counting with counting means for each spinning station the number of anomalous interruptions of the operation thereof, interrogating at the time intervals the count at the respective counting means with an operating device capable of traveling relatively to the spinning stations, and issuing a fault signal automatically if a predetermined count of the respective counting means for the spinning stations is reached or exceeded.

The interrogation periods need not be of equal length, in fact, for the following reason. In an undisturbed rotor spinning operation, about 10 hours pass from the start of the spinning operation i.e. from the thread joining step, until the spinning can runs empty. An operating device e.g. a thread joining device, cleaning device or the like therefore becomes active at one and the same spinning station only once in about every 10 hours, if the spinning operation is undisturbed. Such an interruption of the spinning operation is normal and is not counted. If, however, thread breaks occur during the spinning operation, each thread break is counted as an anomalous interruption of the operation by the counter or counting station or location assigned to the spinning station. By observing the spinning operation, it has been determined in advance how many thread breaks per unit time may occur on the average at the individual spinning stations before a spinning station can be considered to be operating incorrectly. These time intervals are in the order of magnitude of hours. It is therefore unimportant if the time intervals for the interrogations of the counters are not exactly of equal length. In operation, the time interval has also been previously influenced, for example, by the fact that the mobile operating device, during the travel thereof from the beginning to the end of the side of the spinning frame or machine, performs the work assigned to it at the individual spinning stations in an irregular cycle. If the counter interrogation is then performed, for example, during every tenth travel or trip of the operating device, then work of different duration can be performed in addition to the interrogation of the counters, which is the very reason why the interrogation-time intervals vary. If the counters are alternatively interrogated only when the operating device becomes actuated at the respective spinning station, this alone makes for rather different interrogation-time intervals. Nevertheless, the incorrectly operating spinning stations are determined properly, because only they report an anomalous interruption of the operation thereof and cause the operating device to become actuated.

In accordance with another mode of the method invention, after the predetermined count or counter content is reached or exceeded, the counter is automatically reset to a starting position thereof. The procedure can be such that the number of anomalous interruptions of the operation during the counting period just ending is compared with a permissible average value of anomalous operating interruptions per unit time. In that case it is advantageous to reset the counter to a starting position immediately after the count or counter content is interrogated. This starting position need not have the value zero.

In accordance with further alternative modes of the invention, the method includes resetting the counters or counter locations for all of the spinning stations opposite to the counting direction automatically and either simultaneously or successively at predetermined intervals by a given amount to a preceding value in accordance with a common resetting program after a predetermined count has been reached or exceeded. A value greater than zero can thus be set as the starting position such as, for example, the value 10. The resetting program is set up in dependence upon the number of permissible anomalous interruptions of the operation per unit time. If the spinning machine is then in an operating state which, in fact, while not undisturbed, is nevertheless normal, the number of the counted anomalous interruptions of the operation is compensated, on the average, by the automatic counter resettings. With a predetermined tolerance of several interruptions of operation, such as, 4 to 6, for example, the counters of the individual spinning stations, insofar as they deviate only very slightly from the starting position, will cause no fault or trouble signal to be given off. The interrogation of the counters is thereby set so that a fault signal is always given for the spinning station if the mobile operating device becomes actuated at a spinning station and the counter has exceeded the fixed limit at this spinning station. Simultaneously, the counter is reset to the starting position.

In accordance with the device for performing the foregoing method of the invention, there are provided counting means for each of the spinning stations for counting the number of anomalous interruptions of the operation thereof, respectively, a mobile operating device capable of traveling relatively to the spinning stations and including means for interrogating the counting means at time intervals to determine the count, and means for issuing a fault signal automatically in response to the reaching or exceeding of a predetermined count of the respective counting means for the spinning stations.

In accordance with a further feature of the invention, the device includes means for comparing the count interrogated by said interrogating means with a value of the predetermined count.

In accordance with an added feature of the invention, the device includes means for resetting the counting means, respectively, automatically to a given preceding count position thereof in response to the reaching or exceeding of the predetermined count of the counting means.

If the counters are installed at the individual spinning stations, neither the count or counter-content comparison device nor the counter resetting device need be associated with the movable operating device; it is sufficient if the just-mentioned devices are associated directly with the counters.

A compact construction without drag lines or the like is attained in accordance with an additional feature of the invention wherein the counting means for the spinning stations are included in the mobile operating device for traveling therewith relative to the spinning stations.

To select the counter or counter location associated with the respective spinning stations, in accordance with yet other alternate features of the invention, the mobile operating device comprises electronic means, such as a shift register or an address counter, for selecting the respective counting means i.e. the counter or counter location, for the individual spinning stations.

Since a shift register or an address counter can fall out of step due to external influences such as brief interruptions, the shift register or the address counter, in accordance with yet another feature of the invention comprises a synchronizing device for automatically synchronizing data trasfer from the respective station to the respective counter or counter location.

In accordance with yet a further feature of the invention, the counting means are bidirectional counters, and means are included for feeding fault counting pulses in counting direction thereto at a predetermined rhythm corresponding to the fault frequency, as well as means for feeding counting pulses corresponding to actual anomalous interruptions of operation of the respective spinning machine in opposite counting direction.

The counting direction of the anomalous operating interruptions is thereby arbitrary. For example, the operating interruptions can be counted forward and the resetting rhythm backwards or vice versa. If a bidirectional counter is used as the counter, in accordance with a concomitant feature of the invention, means are provided for resetting the individual counters or counter location to a starting position only if a given count or counter content is exceeded or the counter runs over or overflows. In normal operating, the counter of an individual spinning station therefore need not be reset at all, as it always remains in the vicinity of the starting position thereof. If a counter runs over or overflows, the fault trouble signal is given for the respective spinning station, and the counter is reset to the starting value, so that it can again monitor for incorrect operation the spinning station, which is to be cleaned or repaired in the meantime. The trouble or fault signal can be given at the spinning station per se, at a central location or at both places simultaneously.

The advantages derived from the invention are especially that a previously existing and presumed operable operating device which can be moved or can travel relative to the spinning stations can be utilized with little technical effort for determining incorrectly operating spinning stations without requiring this operating device to vary the mode of operation or the operating rythm of those activities thereof for which it is basically intended.

Other features which are considered as characteristic for the invention are set forth in the appended claims.

Although the invention is illustrated and described herein as embodied in method and device to determine defectively operating spinning stations, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
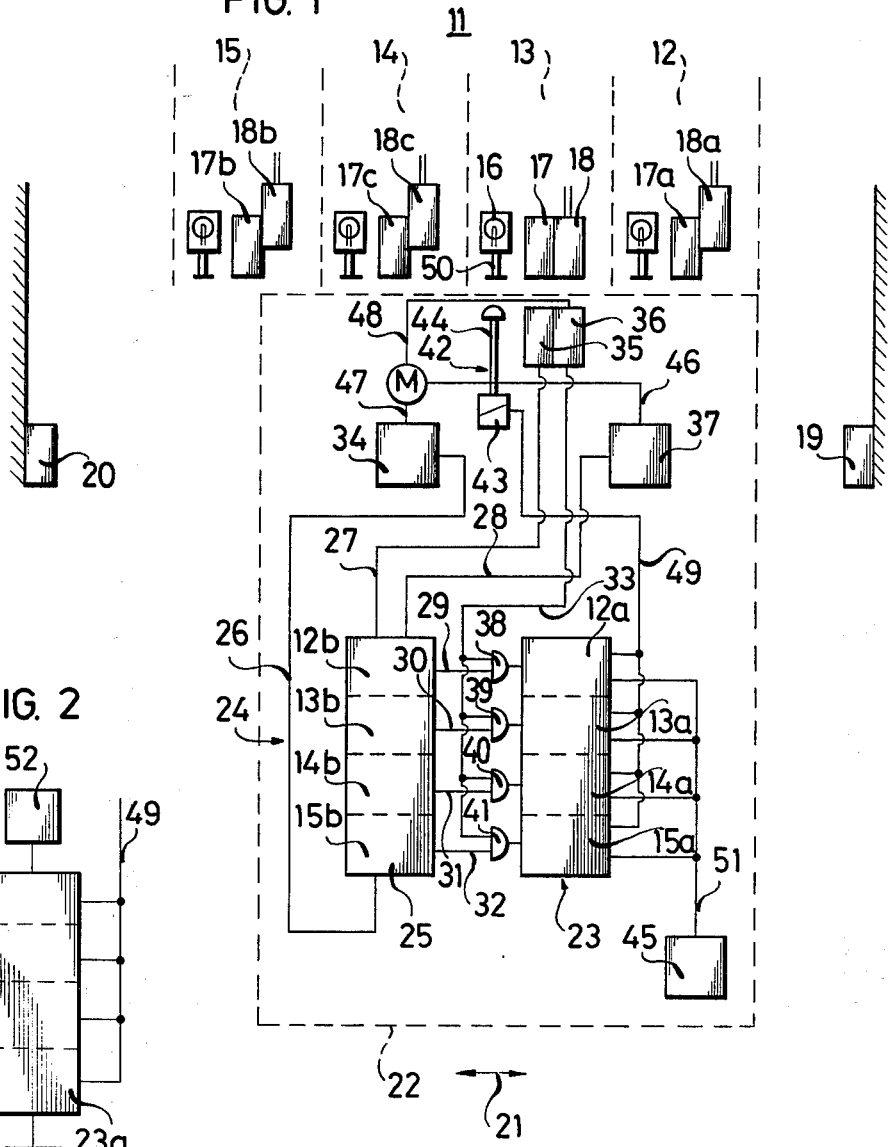
FIG. 1 is a circuit diagram of the device for determining incorrectly operating spinning stations, according to the invention, including a counter on a mobile operating device.

Referring now to the drawing and first, particularly, to FIG. 1 thereof, there is shown diagrammatically part of a spinning frame 11 including spinning stations 12 to 15, which are shown separated by broken lines. For an understanding of the invention it is believed to be sufficient merely to refer only to four spinning stations of the spinning machine and, also to provide no illustration of the parts relating to the spinning process per se. Each spinning station has a fault signal lamp 16, a stationary switching magnet 17 and a moving switching magnet 18. In addition, a switching magnet 19 is located to the right-hand side of the spinning station 12, and a switching magnet 20 to the left-hand side of the spinning station 15.

An operating device 22 movable relative to the spinning stations in direction of the double-headed arrow 21 includes a forwards-and-backwards i.e. bidirectional electronic counter 23 with counting locations 12*a*, 13*a*, 14*a* and 15*a*. The indentification of the counting locations by the reference characters 12*a*, 13*a*, 14*a* and 15*a*, respectively, connotes the relationship thereof to the respective spinning stations 12 to 15. In the operating device 22, is further recognizable a counter-content or count interrogation device 24, formed of an address counter 25 and several electronic components connected by lines 26 to 33 to the address counter 25 or to one another, namely, four proximity switches 34 to 37 and four AND gates 38 to 41.

The operating device 22 additionally includes a fault signal display device 42 formed of an electromagnet 43 and a plunger or armature 44, which is actuatable by the electromagnet 43, as well as of a counter resetting device 45.

During undisturbed normal operation of the spinning frame 11, the operating device 22 travels past the spinning stations 12 to 15 reciprocatingly in direction of the double-headed arrow 21.

In the end position thereof i.e. in front of the spinning stations 12 and 15, respectively, as shown in FIG. 1, the direction of travel of the operating device 22 is reversed. The reversal of the direction of travel in front of the spinning station 12 occurs when the proximity switch 37 approaches the switching magnet 19, whereupon the proximity switch 37 transmits a signal through the line 46 to a motor M driving the undercarriage travel gear for the mobile operating device 22 so that the latter travels toward the left-hand side of FIG. 1. The reversal of the direction of travel in front of the spinning station 15 occurs when the proximity switch 34 approaches the switching magnet 20, whereupon the proximity switch 34 transmits a signal to the undercarriage motor M through the line 47 for effecting travel of the mobile operating device 22 toward the right-hand side of FIG. 1. The motor M receives a stop signal if the proximity switch 36 approaches one of the movable switching magnets 18, 18*a*, 18*b* or 18*c*. Then a signal is transmitted through the line 48 for stopping the travel-mechanism drive motor M.

The proximity switch 36 can approach one of the switching magnets 18, 18*a*, 18*b* or 18*c* only if the respective switching magnet 18, 18*a*, 18*b* or 18*c* is pushed forward into the proximity position, as is the case, for example, at the spinning station 13. The switching magnet 18, 18*a*, 18*b* or 18*c* is effected mechanically and occurs only if a thread break takes place at the respective spinning station 12 to 15.

The operating device 22 starts its travel from the spinning station 12. At the start, the proximity switch 35 is influenced by the stationary switching magnet 17*a*, while the proximity switch 37 is influenced by the stationary switching magnet 19. The proximity switch 37 sets the counting direction of the address counter 25 through the line 28 from the counting location 12*b* in direction toward the counting location 15*b*. The proximity switch 35 transmits a 1-signal over the line 27 to the address counter 25, whereby the counter location 12*b* sends a 1-signal over the line 29 to the AND gate 38. The proximity switch 36 does not respond because the switching magnet 18*a* is not in proximity position thereof. At the output of the AND gate 38, a zero or 0-signal is present, and the setting of the counter 23 remains unchanged.

Since the travel-mechanism motor M is set by the proximity switch 37 to effect travel of the mobile operating device 22 toward the left-hand side of FIG. 1, the operating device 22 continues to travel toward the left-hand side to the spinning station 13. FIG. 1 of the drawing shows the operating device 22 as just having arrived in front of the spinning station 13. In this position, the movable switching magnet 18 is in the proximity position or setting thereof because of a thread break, so that the travel-mechanism motor M has already received a stop signal from the proximity switch 36.

Simultaneously, a 1-signal is sent from the proximity switch 36 over the line 33 to the inputs of the AND gates 38 to 41. From the proximity switch 35, a 1-signal is again sent over the line 27 to the address counter 25 and is transmitted to the next-succeeding counter location 13*b*, the output line 30 of which then likewise send a 1-signal to the input of the AND gate 39. Since both inputs of the AND gate 39 then carry a 1-signal, a 1-signal is transmitted through the output of the AND gate 39 to the counter location 13*a* of the counter 23. The counter location 13*a* counts a further counting unit in the counting direction. Should the counter location 13*a* thereby have run over, there appears at the output thereof and, therefore, on the line 49 also, a 1-signal by which the fault signal display device 42 is switched on. The plunger 44 is driven outwardly by the electromagnet 43 and switches the fault signal lamp 16 on by means of the switch 50 of the latter. A fault signal is thereby set at the spinning position 13. The fault signal is supposed to call to the attention of an operator or servicing personnel that an excessive number of anomalous thread breaks per unit time has occurred at this spinning station. The fault signal lamp 16 can be switched off only manually by an operator. The counter locations of the bidirectional counter 23 are internally connected so that, if a 1-signal appears at the output of a respective counting location, that counting location is automatically reset to the starting position, which can occur, for example, if the counter runs over. If it is part of the normal purpose of the operating device 22 to correct a thread break, it will always do this if a thread break has occurred at a spinning station, even if run-over should not occur in the associated counting location when this thread break is added to the count. Only after the thread break has been removed i.e. corrected, does the operating device 22 travel on to the next spinning station.

If a run-over of the counter location, however, indicates that an anomalous thread break frequency is present, it may be more advantageous in some circumstances not to correct the thread break but first to investigate the cause of the thread break, to clean the spinning turbine and to correct other deficiencies or defects and to prevent thereby, as much as possible, the occurrence of accumulated thread breaks in the future.

As the operating device 22 travels farther, the proximity switch 35, in front of each spinning station, sends a 1-signal to the address counter 25, which shifts this 1-signal from one counter location to the next. Since the switching magnets 18*c* and 18*b* of the spinning stations 14 and 15 are not in the proximity position thereof, the counter locations 14*a* and 15*a* retain their count. In front of the spinning station 15, the proximity switch 34 approaches the switching magnet 20. The proximity switch 34 is thereby closed and sends a 1-signal over the line 26 to the address counter 25, which is thereby caused to reverse the direction of counting from the counter location 15*b* in direction toward the counter location 12*b*. Upon the return travel of the operating device 22, the 1-signal is then shifted through the address counter 25 in the opposite direction due to the signals transmitted by the proximity switch 35, so that the counter locations 15*b*, 14*b*, 13*b* and 12*b* successively deliver a 1-signal whenever the operating device 22 is disposed in front of the associated spinning station because of a thread break.

By means of the counter resetting device 45, counting pulses are now fed over line 51 to the bidirectional counter 23 in the opposite counting direction at a predetermined rate corresponding to the fault frequency determined as normal. In the case at hand, a 1-signal is fed simultaneously to all counter locations of the counter 23 at an interval of several hours, for example, for the purpose of backward-counting by one counting unit. A counter location can then run-over beyond a predetermined value only if the forward counting due to thread breaks occurs more rapidly than the backward counting according to the frequency of thread breaks which is considered to be normal.

The other functions of the operating device 22 will not be discussed at this point. An automatic thread joining device in conjunction with a spinning station cleaning device may be involved, for example. Also, the normal function of a spinning machine, to spin roved yarn or slivers into thread, is generally known and is believed to require no explanation or special illustration at this point.

In the embodiment shown in FIG. 1, an advantageous concentration of all important components of the invention occurs in the mobile or traveling operating device 22. These components need to be provided only once, therefore, in a spinning frame with a hundred or more spinning stations.

Figure 2:
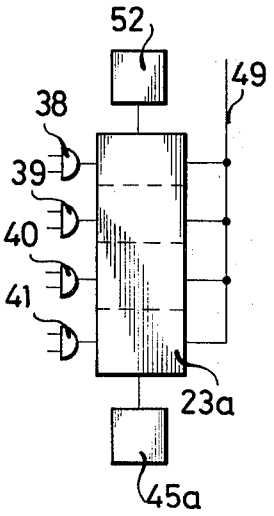
FIG. 2 is a fragmentary view of FIG. 1 showing a modification of the device for determining incorrectly operating spinning stations.

The circuit according to FIG. 1 can be varied or modified in accordance with the illustration according to FIG. 2, in that, instead of the bidirectional counter 23, a counter 23*a* may be used, the individual counter locations of which count only in one direction i.e. only forwardly, for example, the counter 23*a* being resettable, however, to the starting value, for example, the value zero. The resetting to the value zero is effected automatically at adjustable time intervals by a counter resetting device 45*a*.

The counter 23*a* has, in addition, a count comparison device 52 which can be set to a predetermined limit of the counter content or count. If this limit is exceeded at a counter location, a 1-signal appears at the output of this counter location and, thereby, on the line 49, this 1-signal causing the fault signal display device 42 to respond.

In this variant or modified form of the invention, the operating time is subdivided, in a manner of speaking, into monitoring intervals which are apportioned so that during normal, though not entirely undisturbed operation, no counter location exceeds the limit. If this is still the case, then this spinning station is automatically recognized as performing a defective or faulty operation.

Figure 3:
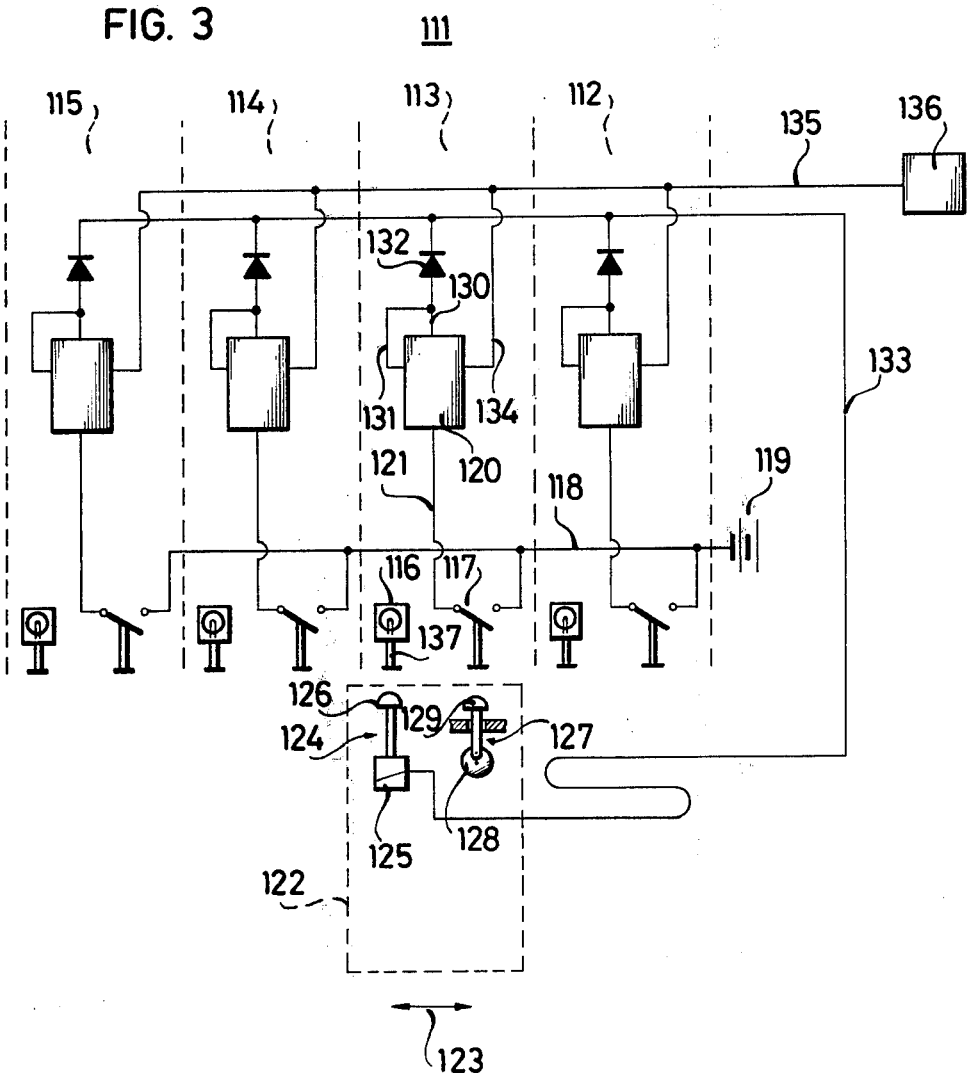
FIG. 3 is a circuit diagram of yet another embodiment of the invention wherein a separate counter is located at each spinning station of the spinning frame.

In the third embodiment of the invention according to FIG. 3, it is noted that a spinning frame 111, not shown in detail, includes spinning stations 112 to 115 which are shown separated by broken lines. Each spinning station 112 to 115 has a fault signal lamp 116 and a switch 117. The switches are connected by a line 118 to a current source 119. A respective bidirectional counter 120 is associated with each spinning station, the input 121 of each counter 120 being connected to the output of the respective switch 117.

An operating device 122, which is capable of traveling relative to the spinning stations in direction of the double-headed arrow 123, includes a fault signal display device 124 formed of an electromagnet 125 and a plunger or armature 126 actuatable by the electromagnet 125, and a count interrogation device 127 formed of a plunger 129 connected to an eccentric shaft 128.

The output 130 of each counter 120 is connected to the clearing input 131 thereof and to the input of a respective diode 132. The outputs of all of the diodes 132 are tied to a bus 133 which leads as a drag line to the electromagnet 125 of the fault signal display device 124. The reset inputs 134 of all the counters 120 are connected to a line 135 which is, in turn, connected to a counter resetting device 136.

In a conventional manner which is not described in detail herein, the operating device 122 is held at a spinning station during its travel past the spinning station only if work is to be performed at this spinning station i.e. a thread break is to be corrected, for example, thereat. In this case, the operating device 122 is first arrested at the spinning station, for example at the spinning station 113 in the embodiment of the invention according to FIG. 3. Then the eccentric shaft 128 makes one revolution, whereby the count interrogation device 127 closes the switch 117 briefly and opens it again. Thus, a counting pulse is sent into the counter 120 through the input 121. If the counter 120 reaches its limit or runs over due to this pulse, then a 1-signal is present at the output 130 and is fed through the diode 132 to the bus 133. Simultaneously, the counter is cleared through the clearing input 131. The diodes of the other counters prevent a reaction on the counters of the other spinning stations. A consequence of the 1-signal being applied to the bus 133 is that the plunger 126 of the fault signal display device 124 actuates the switch 137 of the fault signal lamp 116 and thereby switches the lamp 116 on. The fault signal lamp 116 draws attention to the fact that an excessively large number of anomalous thread breaks per unit time has occurred at this spinning station. The fault signal lamp 116 can only be switched off manually by an operator.

The counter resetting device 136 feeds counting pulses with opposite counting direction to the bidirectional counters 120 of all the spinning stations over the line 135 at a predetermined rhythm corresponding to a fault frequency which has been determined to be or is considered to be normal. An individual counter 120 can threfore run-over beyond a predetermined value only if the forward counting caused by thread breaks, occures more rapidly than the backward counting corresponding to the frequency of thread breaks that is considered to be normal.

This variant or modification of the invention has an advantageously simple circuit. The control or actuating elements are concentrated in the mobile control device and are therefore provided only once. Although each spinning station, in fact, has its own counter, the latter can be of very simple construction and needs to count only a few steps forward and backward. Furthermore, several counters are combinable too, into a single counter with correspondingly numerous counter locations. However, this counter need not be stationed on or fixed to the mobile operating device. The electronic counters are replaceable alternatively by mechanical counting mechanisms of simple construction.

There are claimed:

1. Method of determining incorrectly operating spinning stations of a spinning machine which comprises counting with separate counting means for each spinning station the number of anomalous interruptions of the operation thereof exclusively at the respective spinning station, interrogating at time intervals the count at the respective counting means with an operating device capable of traveling relatively to the spinning stations, and issuing a fault signal automatically if a pre-determined count of the respective counting means for the respective spinning stations is at least reached.

2. Method according to claim 1 which includes resetting the counting means automatically to starting position thereof after a predetermined count has been at least reached.

3. Method according to claim 1 which includes resetting the counting means for all of the spinning stations opposite to the counting direction automatically and simultaneously by a given amount to a preceding value in accordance with a common resetting program after a predetermined count has been at least reached.

4. Method according to claim 1 which includes resetting the counting means for all of the spinning stations opposite to the counting direction automatically and successively at predetermined time intervals by a given amount to a preceding value in accordance with a common resetting program after a predetermined count has been at least reached.

5. Device for performing a method of determining incorrectly operating spinning stations of a spinning machine comprising separate counting means located at the respective spinning stations at least at a given time at which they are effective for counting the number of anomalous interruptions of the operation exclusively at the respective spinning stations, a mobile operating device capable of traveling relatively to the spinning stations and including means for interrogating said counting means at time intervals to determine the count, and means for issuing a fault signal automatically in response to at least the reaching of a predetermined count of the respective counting means for the spinning stations.

6. Device according to claim 5 including means for comparing the count interrogated by said interrogating means with a value of said predetermined count.

7. Device according to claim 5 including means for resetting said counting means, respectively, automatically to a given preceding count position thereof in response to the reaching of the predetermined count of said counting means.

8. Device according to claim 5 wherein said counting means for the spinning stations are included in said mobile operating device for traveling therewith relative to the spinning stations.

9. Device according to claim 8 wherein said mobile operating device comprises electronic means for selecting the respective counting means for the individual spinning stations.

10. Device according to claim 9 wherein said electronic selecting means is a shift register.

11. Device according to claim 9 wherein said electronic selecting means is an address counter.

12. Device according to claim 9 wherein said electronic selecting means comprises a synchronizing device for automatically synchronizing data transfer from the respective spinning sation to the respective counting means.

13. Device according to claim 5 wherein said counting means are bidirectional counters, and including means for feeding fault counting pulses in counting direction thereto at a predetermined rhythm corresponding to the fault frequency, and means for feeding counting pulses corresponding to actual anomalous interruptions of operation of the respective spinning machine in opposite counting direction.

14. Device according to claim 13 including means for resetting the respective bidirectional counter to a starting position only in response to the exceeding of a predetermined count or the counter has run over.

* * * * *